US006035587A

United States Patent [19]

Dressler

[11] Patent Number: 6,035,587

[45] Date of Patent: Mar. 14, 2000

[54] ROOF DRIP EDGE WITH FLEXIBLE LEG

[75] Inventor: Robert D. Dressler, Mechanicsburg, Pa.

[73] Assignee: Amerimax Home Products, Inc., Lancaster, Pa.

[21] Appl. No.: 09/052,355

[22] Filed: Mar. 31, 1998

[51] Int. Cl.[7] ..... E04D 13/15

[52] U.S. Cl. ..... 52/97; 52/716.2; 52/717.03; 52/717.05

[58] Field of Search ..... 52/97, 11, 716.2, 52/717.03, 717.05

[56] References Cited

U.S. PATENT DOCUMENTS

| | | | |
|---|---|---|---|
| 873,407 | 12/1907 | Behl . | |
| 2,276,804 | 3/1942 | Taylor et al. . | |
| 2,596,786 | 5/1952 | Norrid . | |
| 2,613,621 | 10/1952 | Schraeder . | |
| 2,943,421 | 7/1960 | Squires . | |
| 3,137,970 | 6/1964 | Tiernan . | |
| 3,188,772 | 6/1965 | Tennison, Jr. . | |
| 3,243,926 | 4/1966 | Keyt . | |
| 3,254,460 | 6/1966 | Bowser . | |
| 3,333,803 | 8/1967 | Landis . | |
| 4,254,594 | 3/1981 | Hammond et al. . | |
| 4,271,643 | 6/1981 | Sweers . | |
| 4,300,319 | 11/1981 | Frost et al. . | |
| 5,170,597 | 12/1992 | Stearns . | |
| 5,181,350 | 1/1993 | Meckstroth . | |
| 5,375,379 | 12/1994 | Meckstroth . | |
| 5,586,414 | 12/1996 | Tawzer | 52/97 X |
| 5,694,726 | 12/1997 | Wu | 52/717.03 X |

OTHER PUBLICATIONS

Empire Scroll Flashing, product literature.

*Primary Examiner*—Christopher T. Kent
*Attorney, Agent, or Firm*—Arnall Golden & Gregory, LLP

[57] ABSTRACT

A drip edge for use on a building roof for directing water off of the roof, away from the building and, preferably, into a gutter is provided. The drip edge includes a planar body portion which is positioned under the roofing shingles. An open throat portion, which is substantially U-shaped, can fit over an existing protruding drip edge. A downwardly extending leg portion has a lower flexible section which ends in an outwardly directed foot portion. The drip edge can be installed over an existing drip edge, allowing retrofit of the new drip edge. The drip edge can be used with a variety of gutter designs. The drip edge prevents water from getting between the fascia and the gutter inner wall, protecting the building from water damage and the gutter from damage due to ice accumulation, for example.

8 Claims, 3 Drawing Sheets

ROOF DRIP EDGE WITH FLEXIBLE LEG

FIELD OF THE INVENTION

The present invention is directed to a drip edge for use on a building to direct water away from the building and into the gutter.

BACKGROUND OF THE INVENTION

Many buildings include a plurality of upstanding walls covered by a roof. The roof is typically downward sloping and covered by a plurality of shingles. The section of the wall near the roof is often covered by a fascia strip for protection and also to allow installation of a gutter to collect water and other debris that rolls off of the roof.

A disadvantage of such roof constructions is that water often seeps between the gutter inner wall and the fascia strip, causing rot and deterioration of the fascia strip. Moreover, in some types of construction, water can seep between the fascia and the side wall of the building, causing even more extensive damage. Water can also seep in between the roof shingles and the roof boards, causing rot and deterioration of these structural elements.

In an attempt to ameliorate these problems, drip edges are sometimes installed. A simple drip edge may be a planar sheet of plastic or metal inserted between the shingles and the roof which extends out over the edge of the roof, at the same downward slope as the roof. In this way, the water and other debris from the roof is directed away from the building. Commonly, the water and other debris is directed into a gutter.

More elaborate drip edges have been developed such as, for example, those described in U.S. Pat. No. 4,254,594 to Hammond et al., U.S. Pat. No. 2,943,421 to Squires, and U.S. Pat. No. 5,170,597 to Stearns. Each of these drip edges includes a planar portion for inserting under the roof shingles to attach the drip edge to the roof. In each drip edge, the outside edge folds back on itself to form an outward jutting edge. Rain and debris are deflected away from the building with this outward jutting edge. Each drip edge also includes a leg portion extending downward from the folded portion. The leg portion is meant to extend into a gutter and function to keep water away from the fascia.

The prior art assemblies are designed to be installed on bare fascia and roof. In other words, any previously existing installed drip edge or gutter must be removed before the new drip edge can be installed. Moreover, the leg portions that extend into the gutter are inflexible. In such a design, the gutter must be positioned a particular distance below the drip edge, which also limits the ability to retrofit the drip edge assembly.

An object of the invention is to provide a roof drip edge to prevent the entry of water between the gutter and building fascia.

Another object of the invention is to provide a roof drip edge that can be installed over an existing drip edge.

BRIEF SUMMARY OF THE INVENTION

A drip edge for use on a building roof for directing water off of the roof, away from the building and, preferably, into a gutter is provided. The drip edge includes a planar body portion which is positioned under the roofing shingles. The drip edge is provided with an open throat portion, which is substantially U-shaped and can fit over an existing protruding drip edge. A downwardly extending leg portion has a lower flexible section which ends in an outwardly directed foot portion. The drip edge can be installed over an existing drip edge, allowing retrofit of the new drip edge. The leg portion is longer than legs of prior art drip edges, which aids in preventing water from getting behind the gutter. The drip edge can be used with a variety of gutter designs. The drip edge substantially prevents water from getting between the fascia and the gutter inner wall, protecting the building from water damage and the gutter from damage due to ice accumulation, for example.

DETAILED DESCRIPTION OF THE INVENTION

Figure 1:
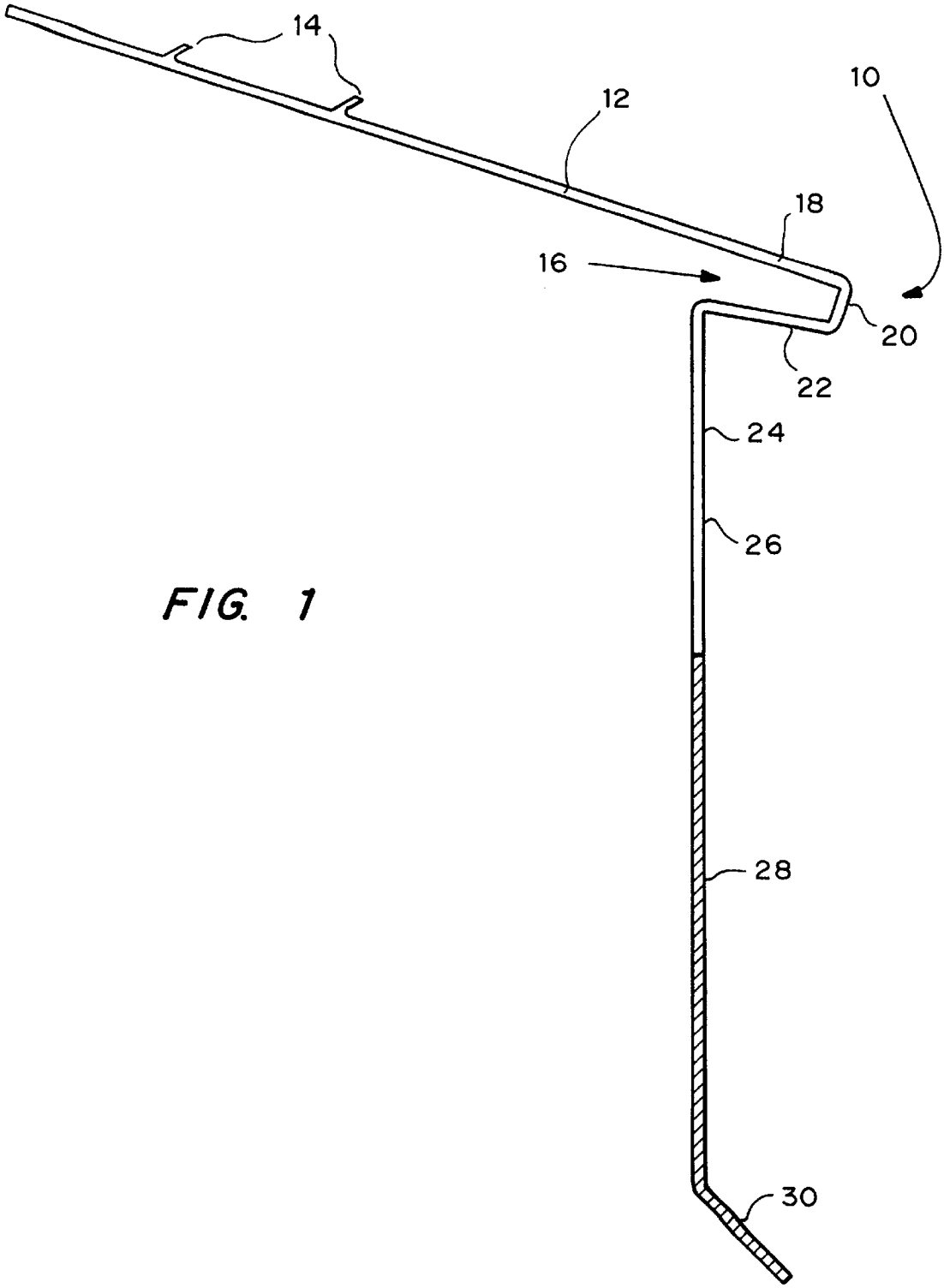
FIG. 1 is a side elevational view of a preferred embodiment of the drip edge.
Figure 2:
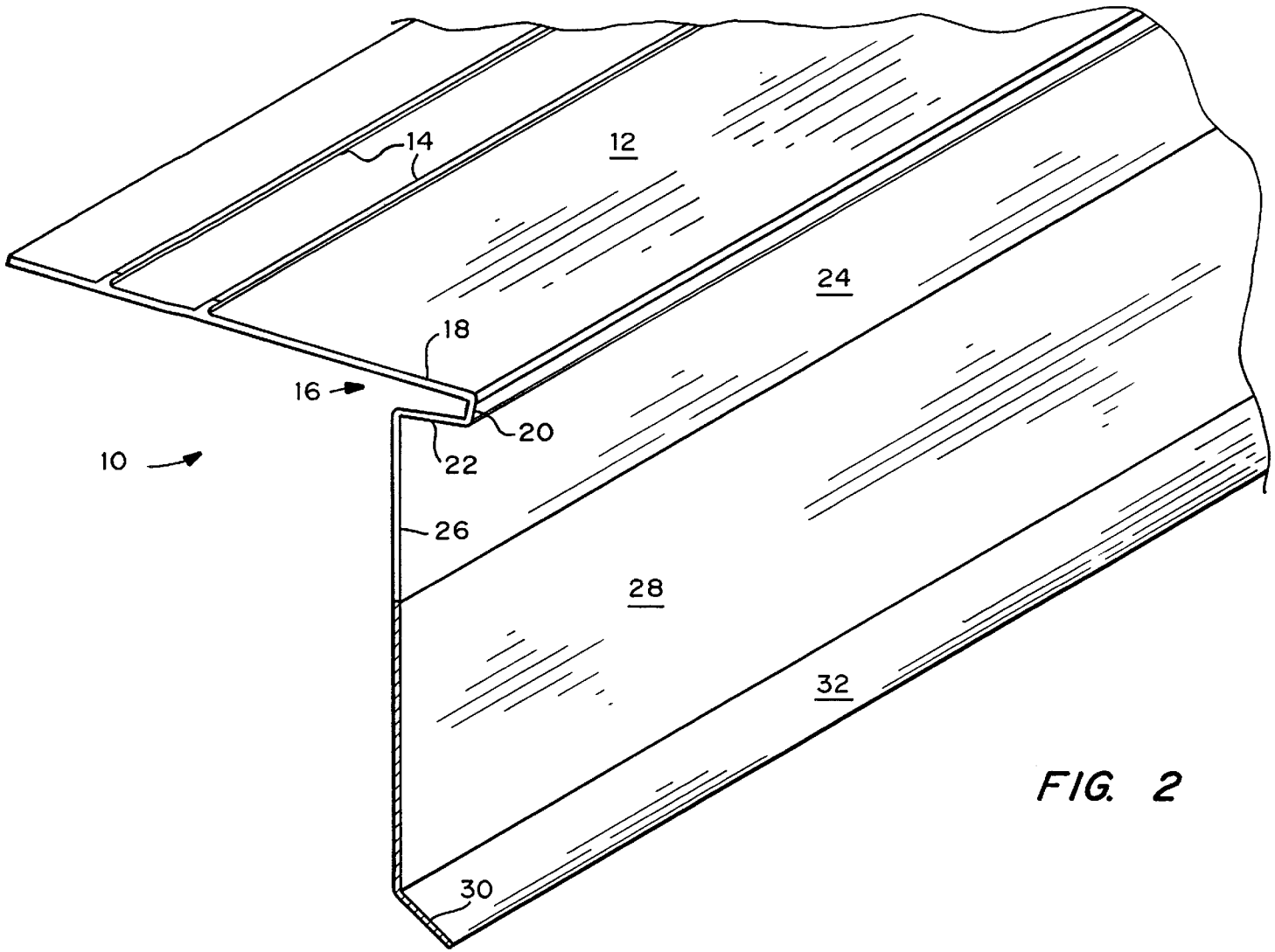
FIG. 2 is a perspective view of a preferred embodiment of the drip edge.

As shown in FIGS. 1 and 2, the roof drip edge 10 includes a planar body portion 12 that measures from about one to ten inches in width. Preferably, the width is about 2½ inches, which provides enough width to securely install the drip edge under the shingles, as described below. The drip edge can be provided in a length, such as about 6 or 12 feet, that is convenient for installation and transportation.

One or more raised ribs 14 (two are shown in the FIGS.) extend longitudinally along planar body 12. The raised ribs 14 are directed at an acute angle to planar body 12 and have a pointed, rather than smooth, tip. A U-shaped throat portion 16 is connected to planar portion 12 and includes a first wall 18 that is contiguous with the planar body 12, a second wall 20 extending substantially perpendicularly from first wall 18, and a third wall 22 extending substantially perpendicularly from second wall 20. The U-shaped portion 16 is preferably sized to accept the edge of the roof or previously installed drip edge, as further discussed below.

Leg portion 24 extends downwardly from third wall 22 of U-shaped throat portion 16 at an angle of around 108°. This angle allows the drip edge to be used with a commonly used roof slope but the drip edge can be designed having any desired shape. Leg portion 24 includes an upper section 26, a lower leg section 28, and an outwardly extending foot section 30. The foot section 30 forms a downwardly sloping ledge 32, as shown in FIG. 2. The leg portion can be from about one inch to five inches in width, dependent in part upon the depth of the gutter above which it is installed, as discussed above. Preferably, it is about 2½ inches wide, with the flexible lower portion being about 1½ inches in width. Outwardly extending foot 30 preferably is directed at an angle of about 45° from lower leg section 28.

The planar body 12, throat portion 16 and upper leg portion 26 should be inflexible so that the drip edge can be easily handled during installation. Preferably, the planar body 12, throat portion 16 and upper leg portion 26 are integrally formed of plastic, such as a rigid 35 mil (0.035") poly(vinyl chloride) (PVC) which is UV protected. Alternatively, these portions can be made of other rigid plastics, such as polyethylene, polypropylene, polybutylene, silicon plastics, and ethylene propylene diene monomer (EPDM), and metals, such as aluminum and steel.

The lower leg portion 28, and the foot 30, are relatively more flexible than the other portions and may be formed along with the other portions or attached to the other portions in a separate step. The lower leg portion is made of a more flexible material such as flexible UV-protected PVC. This section can also be made of the materials referenced above.

The drip edge can be made as an integral unit such as by extrusion or roll forming, depending upon the material that is used. The preferred method of making the product is extrusion.

Figure 3:
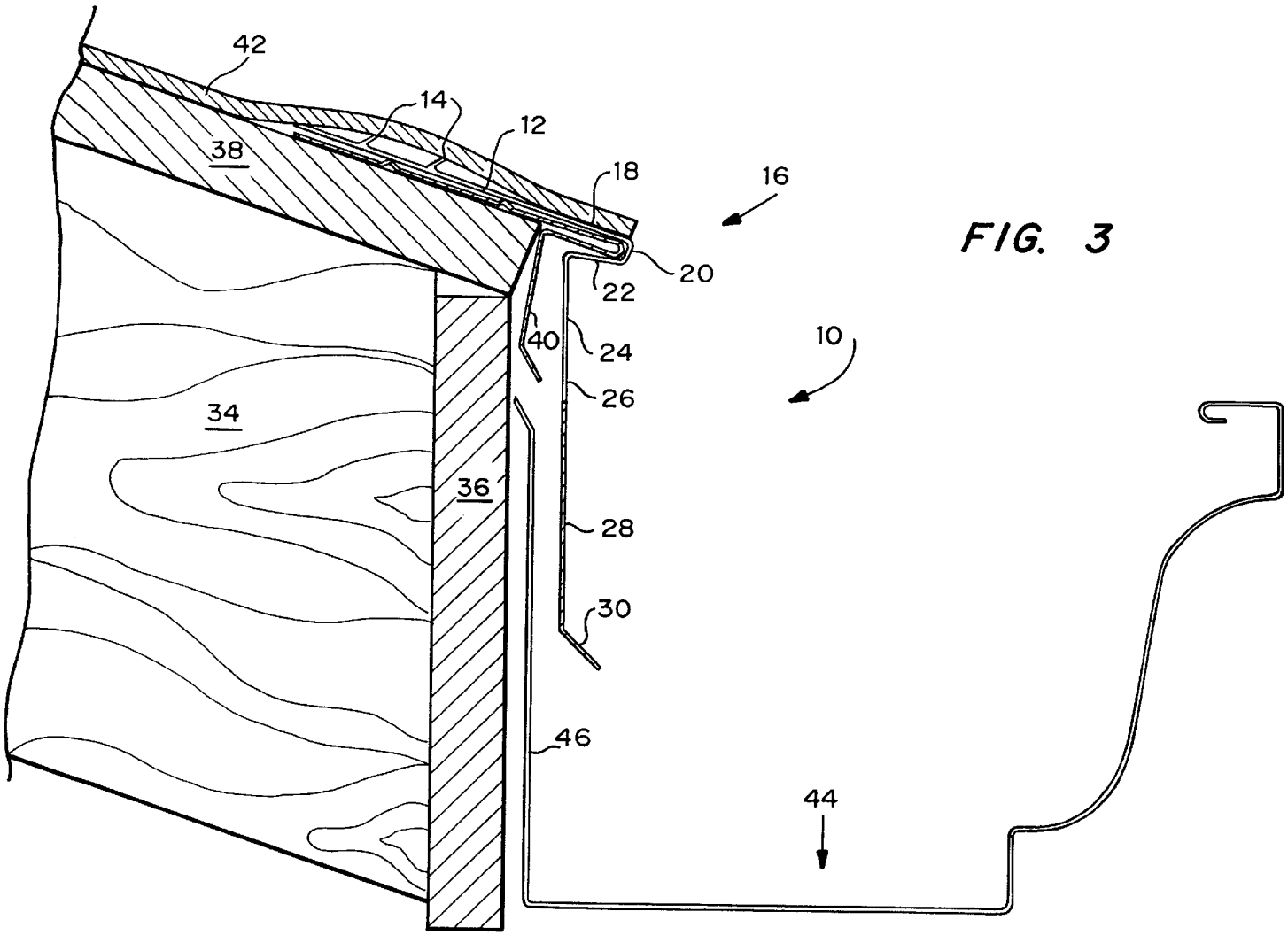
FIG. 3 is a cross sectional view of a preferred embodiment of the drip edge installed onto a building. A gutter is also installed on the building.

FIG. 3 illustrates the method of installation of the drip edge. The building 34 includes fascia 36 which is attached to the ends of the roof rafters (not shown) and roof 38. A previously installed drip edge, 40, is fastened to the roof 38. As shown, the previously installed drip edge 40 extends out over the fascia 36. Shingles 42 are fastened to the sloping roof 38.

A gutter 44 is installed in a typical manner, such as by nailing the vertically extending inner wall 46 of the gutter to the fascia 36.

The planar body 12 of drip edge 10 is inserted between the shingles 42 and the roof 38, over the previously installed drip edge 40. The planar portion will lie generally flat upon the roof 38 and previously installed drip edge 40 and can be fastened to the roof 38 by nails or other fastening means. Ribs 14 will engage the under side of shingles 42 and will also retain the drip edge 10 in place. U-shaped throat 16 accommodates the edge of the previously installed drip edge 40 and allows installation of the drip edge over the previously installed drip edge. Leg portion 24 extends downwardly from the planar body 12 and hangs over the wall 46 of the gutter 44. Because the lower leg portion 28 is flexible and can fold longitudinally, the drip edge is still useful even if the leg is longer than the gutter depth.

The flexibility of lower leg portion 28 allows installation of the drip edge over nearly all of the various hangers and fasteners that are used to attach gutters to the fascia. The outwardly angled foot 30 directs water away from the space between the leg and the gutter wall and thus away from the fascia. The leg portion 24 of the drip edge is longer than the leg portion of prior art drip edges, which provides more protection to the fascia by better preventing water from entering the space between the gutter and the fascia.

The teachings of the references cited herein are specifically incorporated herein. Modifications and variations of the present invention will be obvious to those skilled in the art from the foregoing detailed description and are intended to be encompassed by the following claims.

What is claimed is:

1. A drip edge for installation on a roof, comprising:

a substantially planar body portion adapted to lie flat against the roof;

a leg portion extending downwardly from the planar portion and including an upper section and a lower section, wherein the lower section is more flexible than the upper section; and a throat portion connecting the planar body portion and the leg portion.

2. The drip edge of claim 1, wherein the connecting throat portion is U-shaped and adapted to accept the edge of a previously installed drip edge.

3. The drip edge of claim 1, wherein the lower section includes an outwardly directed foot.

4. The drip edge of claim 1, wherein the drip edge is adapted to be installed over an existing drip edge.

5. The drip edge of claim 1, wherein the lower section is flexible poly(vinyl chloride).

6. The drip edge of claim 1 wherein the leg has a width sufficient to extend substantially the depth of a gutter.

7. The drip edge of claim 1 wherein the planar body portion includes one or more raised ribs extending longitudinally along the planar body.

8. The drip edge of claim 1 wherein the planar body portion, the throat portion, and the upper section of the leg portion are formed of rigid plastic.

* * * * *